US009659535B2

(12) United States Patent
Park et al.

(10) Patent No.: US 9,659,535 B2
(45) Date of Patent: May 23, 2017

(54) DISPLAY DEVICE

(71) Applicant: Samsung Display Co. Ltd., Yongin, Gyeonggi-Do (KR)

(72) Inventors: Dong Won Park, Hwaseong-si (KR); Cheol Woo Park, Suwon-si (KR); Bong Hyun You, Yongin-si (KR)

(73) Assignee: SAMSUNG DISPLAY CO. LTD., Gyeonggi-Do (KR)

( * ) Notice: Subject to any disclaimer, the term of this patent is extended or adjusted under 35 U.S.C. 154(b) by 369 days.

(21) Appl. No.: 14/160,865

(22) Filed: Jan. 22, 2014

(65) Prior Publication Data

US 2015/0062105 A1 Mar. 5, 2015

(30) Foreign Application Priority Data

Aug. 30, 2013 (KR) ..... 10-2013-0104207

(51) Int. Cl.
*G09G 3/36* (2006.01)
*G09G 3/20* (2006.01)

(52) U.S. Cl.
CPC ..... *G09G 3/36* (2013.01); *G09G 3/20* (2013.01); *G09G 2310/0248* (2013.01); *G09G 2320/0271* (2013.01); *G09G 2330/06* (2013.01)

(58) Field of Classification Search
CPC ..... G09G 3/3696; G09G 2310/0289; G09G 3/3648; G09G 2310/0251; G09G 2320/0223; G09G 2320/0285
See application file for complete search history.

(56) References Cited

U.S. PATENT DOCUMENTS 5,892,504 A * 4/1999 Knapp ..... G09G 3/367 345/204
8,289,049 B2 * 10/2012 Matsushima ..... H04L 25/0288 326/29
2007/0216624 A1 * 9/2007 Kimura ..... G09G 3/2011 345/89
2008/0218496 A1 * 9/2008 Song ..... G09G 3/3688 345/204
2012/0206506 A1 * 8/2012 Kim ..... G09G 3/20 345/690
2012/0212474 A1 * 8/2012 Hwang ..... G09G 3/3648 345/212
2013/0127804 A1 * 5/2013 Kim ..... G09G 3/3648 345/211
2013/0134430 A1 * 5/2013 Yamazaki ..... G02F 1/13454 257/71

FOREIGN PATENT DOCUMENTS

KR 1020070010917 A 1/2007
KR 1020120094722 A 8/2012
KR 101219439 B1 1/2013
KR 1020130032718 A 4/2013

* cited by examiner

*Primary Examiner* — Andrew Sasinowski
(74) *Attorney, Agent, or Firm* — Cantor Colburn LLP

(57) ABSTRACT

A display device includes a timing controller configured to generate an image signal including a pre-emphasis voltage, a data driver configured to generate a plurality of data signals based on the image signal, and provide information about whether the image signal is normally received or not to the timing controller, and a display panel configured to receive the plurality of data signals and display images corresponding to the received data signals, where when the data driver fails to normally receive the image signal, the timing controller increases a level of the pre-emphasis voltage.

17 Claims, 6 Drawing Sheets

DISPLAY DEVICE

This application claims priority to Korean Patent Application No. 10-2013-0104207, filed on Aug. 30, 2013, and all the benefits accruing therefrom under 35 U.S.C. 119, the contents of which in its entirety are herein incorporated by reference.

BACKGROUND

1. Filed

Exemplary embodiments of the invention relate to a display device, and more particularly, to a display device including a timing controller that generates an image signal including a pre-emphasis voltage.

2. Description of Related Art

A display device may include a display panel on which an image is displayed and a driver for driving the display panel. The display panel may be classified into various types, such as a liquid crystal display panel, a plasma display panel, an electrophoretic display panels, and an electroluminance display panel, and the type of display device may be determined by the type of the display panel included therein.

The driver may include a timing controller, a data driver and a scan driver. The timing controller may control the data driver and the scan driver in response to information about an image provided from the outside. The data driver may generate a data signal for controlling a gray scale displayed at each of a plurality of pixels included in the display panel, and provide the generated data signal to the display panel. The scan driver may generate a scan signal controlling whether to transfer the data signal to each of the plurality of pixels, and provide the generated scan signal to the display panel.

When a distance between the timing controller and the data driver is increased according to an increase in a size of the display device, or when an interval between elements inside the display device is decreased according to a decrease in a size of the display device, a noise may occur in a signal transferred from the timing controller to the data driver. When the quantity of noise in the signal transferred from the timing controller to the data driver is increased, the data driver may not normally receive the signal, thereby degrading a display quality of the display device.

SUMMARY

Exemplary embodiments of the invention provide a display device with improved reception rate, at which a data driver normally receives a signal transferred from a timing controller.

Exemplary embodiments of the invention provide a display device with improved recognition rate, at which the data driver recognizes a signal transferred from the timing controller, and with decreased power consumption.

According to an exemplary embodiment of the invention, a display device includes: a timing controller configured to generate an image signal including a pre-emphasis voltage; a data driver configured to generate a plurality of data signals based on the image signal, and to provide information about whether the image signal is normally received or not to the timing controller; and a display panel configured to receive the plurality of data signals and display images corresponding to the received data signals, where when the data driver fails to normally receive the image signal, the timing controller increases a level of the pre-emphasis voltage.

According to another exemplary embodiment of the invention, a display device includes: a timing controller configured to generate a plurality of image signals, wherein each of the image signals includes a pre-emphasis voltage; a plurality of data drivers configured to receive the plurality of image signals, respectively, and generate a plurality of data signals based on the plurality of image signals, and to provide information about whether the plurality of image signals is normally received or not to the timing controller; and a display panel configured to receive the plurality of data signals and display images corresponding to the received data signals, where when at least one data driver of the plurality of data drivers fails to normally receive an image signal provided thereto, the timing controller increases a level of the pre-emphasis voltage of the image signal provided to the at least one data driver.

In such embodiments, the display device has improved reception rate, at which the data driver normally receives a signal transferred from the timing controller, with decreased power consumption.

BRIEF DESCRIPTION OF THE DRAWINGS

The above and other features of the invention will become more apparent by describing in detail embodiments thereof with reference to the attached drawings, in which.

DETAILED DESCRIPTION

Figure 1:
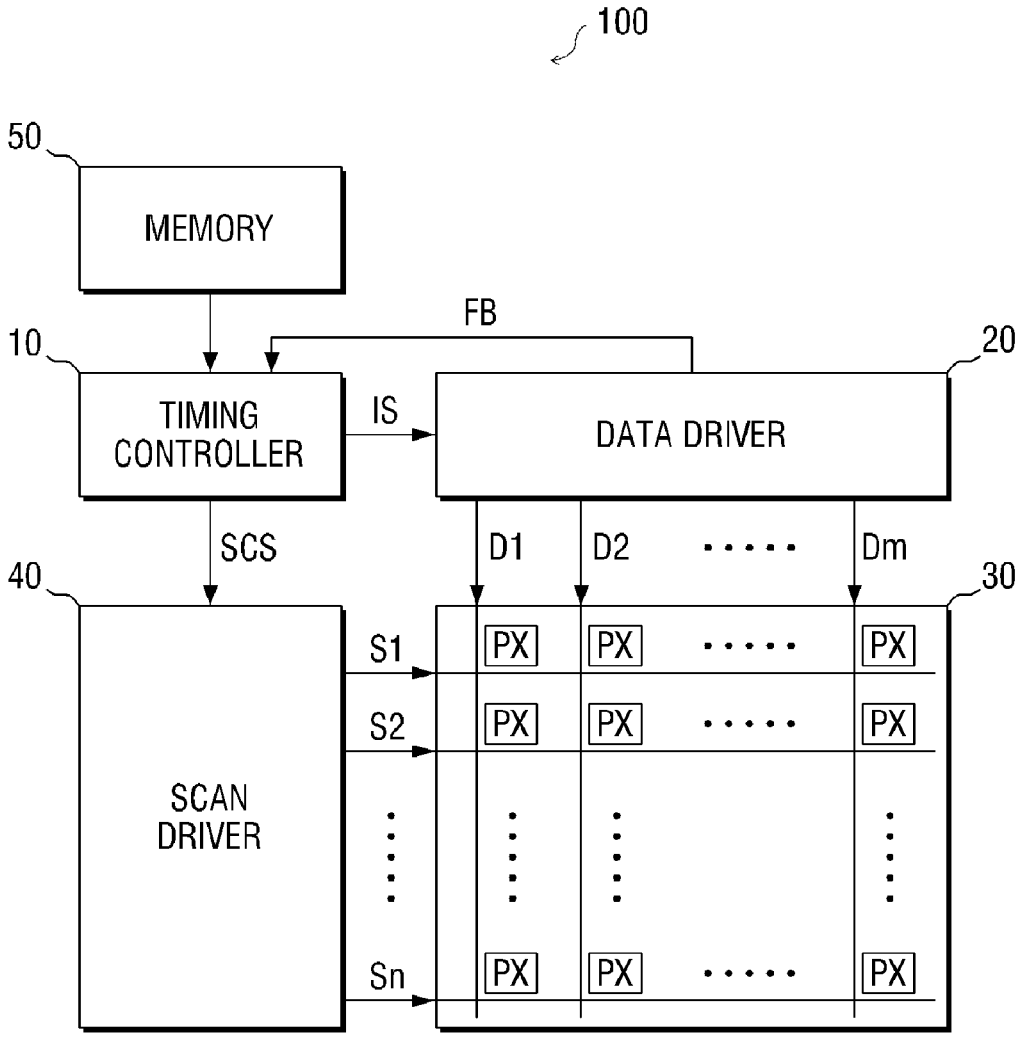
FIG. 1 is a block diagram showing an exemplary embodiment of a liquid crystal display device, according to the invention.

The invention now will be described more fully hereinafter with reference to the accompanying drawings, in which various embodiments are shown. The invention may, however, be embodied in many different forms and should not be construed as being limited to the embodiments set forth herein. Rather, these embodiments are provided so that this disclosure will be thorough and complete and will fully convey the concept of the invention to those skilled in the art. Like reference numerals refer to like elements throughout the specification.

The terminology used herein is for the purpose of describing particular embodiments only and is not intended to be limiting of the invention. As used herein, the singular forms "a", "an" and "the" are intended to include the plural forms as well, unless the context clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which the invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Hereinafter, exemplary embodiments of the invention will be described with reference to the accompanying drawings.

FIG. 1 is a block diagram showing an exemplary embodiment of a liquid crystal display device, according to the invention. Referring to FIG. 1, an exemplary embodiment of a display device 100 includes a timing controller 10, a data driver 20 and a display panel 30.

The timing controller 10 may generate an image signal IS and provide the generated image signal IS to the data driver 20. The image signal IS may include information about a gray scale of an image displayed on the display panel 30, and may further include control signals for controlling the data driver 20, such as horizontal synchronization signal. The image signal IS may include a pre-emphasis voltage that may allow the data driver 20 to normally (e.g., effectively) receive the image signal IS. In an exemplary embodiment, when the data driver 20 fails to normally receive the image signal IS, the timing controller 10 may allow the data driver 20 to normally receive the image signal IS by increasing a level of the pre-emphasis voltage. In such an embodiment, only when the data driver 20 fails to normally receive the image signal IS, the timing controller 10 increases a level of the pre-emphasis voltage, thereby allowing the data driver 20 to normally receive the image signal IS and effectively preventing unnecessary power consumption of the display device 100. Operation of the data driver 20 based on the image signal IS will be described later in greater detail. The timing controller 10 may generate a scan driver control signal SCS for controlling a scan driver 40 and provide the generated scan driver control signal SCS to the scan driver 40.

The data driver 20 may receive the image signal IS, generate a plurality of data signals D1, D2, . . . , and Dm corresponding to the received image signal IS, and provide the generated data signals D1, D2, . . . , and Dm to the display panel 30. The plurality of data signals D1, D2, . . . , and Dm may include information about gray scales displayed at a plurality of pixels PX included in the display panel 10. The data driver 20 may provide information about whether the image signal IS is normally received to the timing controller 10. The data driver 20 may normally receive the image signal IS when the data driver 20 accurately interprets information included in the image signal IS. When the quantity of noises in the image signal IS is increased, the data driver 20 may not normally receive the image signal IS. In an exemplary embodiment, the data driver 20 may provide whether the image signal IS is normally received to the timing controller 10 through a feedback channel FB.

The display panel 30 may receive the plurality of data signals D1, D2, . . . , and Dm and display images corresponding to the received data signals. The display panel 30 may include the plurality of pixels PX, which is a unit for displaying an image. The plurality of pixels PX may be disposed substantially in a matrix form, but not being limited thereto. The display panel 30 including the plurality of pixels PX may further receive a plurality of scan signals S1, S2, . . . , and Sn, and the plurality of scan signals S1, S2, . . . , and Sn may control application of the plurality of data signals D1, D2, . . . , and Dm to the plurality of pixels PX.

In an exemplary embodiment, the display panel 30 may further include the scan driver 40 and a memory 50. The scan driver 40 may receive the scan driver control signal SCS, generate the plurality of scan signals S1, S2, . . . , and Sn corresponding to the received scan driver control signal SCS, and provide the generated scan signals to the display panel 30. Information about a level of the pre-emphasis voltage may be stored in the memory 50. In one exemplary embodiment, for example, the pre-emphasis voltage may have one of first to $x^{th}$ voltages aligned in an ascending order, and information about the first to $x^{th}$ voltages may be stored in the memory 50. Herein, x is an integer larger than 1.

Figure 2:
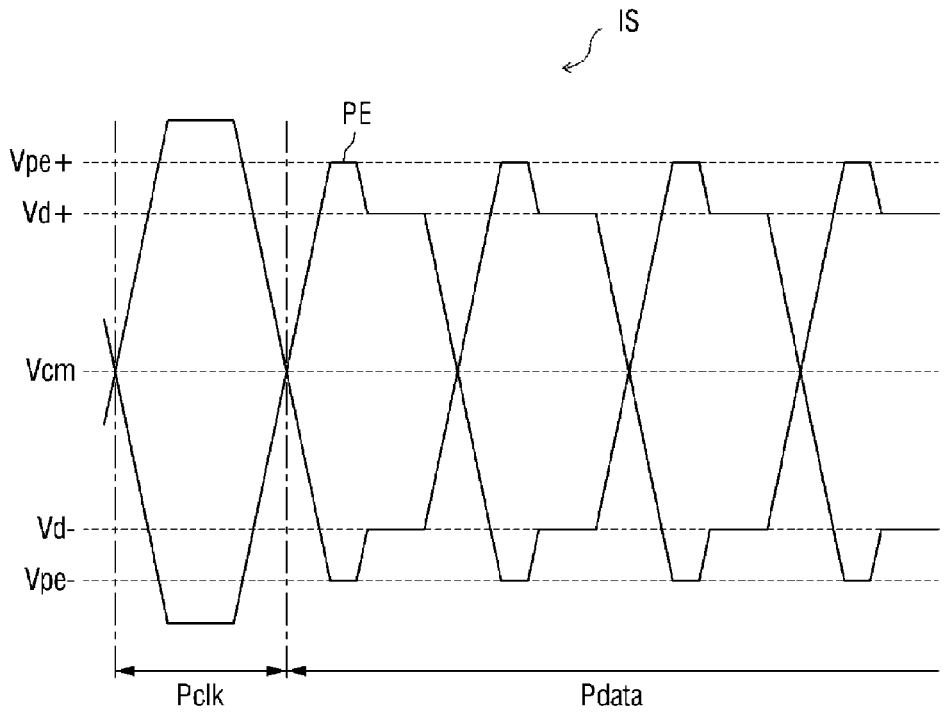
FIG. 2 is a waveform diagram illustrating an image signal in an exemplary embodiment of a liquid crystal display device, according to the invention.

Hereinafter, the image signal IS of an exemplary embodiment of a liquid crystal display device will be described in greater detail with reference to FIG. 2. FIG. 2 is a waveform diagram illustrating the image signal of an exemplary embodiment of a liquid crystal display device, according to the invention.

Referring to FIG. 2, the image signal IS may be divided into a clock section Pclk and a data section Pdata. In an exemplary embodiment, as shown in FIG. 2, a clock signal is embedded in data in the image signal IS, but not being limited thereto. According to alternative exemplary embodiments, the image signal IS may include only data, and the image signal IS may not include the clock section Pclk. The image signal IS may include a pre-emphasis voltage PE. The pre-emphasis voltage PE may be provided by applying a voltage (Vpe+, Vpe−) having a higher voltage level than a voltage (Vd+, Vd−) of data to a head part (e.g., an initial portion of high level period) of the data transferred in the data section Pdata for a predetermined time. In an exemplary embodiment, where the image signal IS includes the pre-emphasis voltage PE, a possibility that the data driver 20 may normally receive the image signal IS may be increased. In such an embodiment, as the voltage level (Vpe+, Vpe−) of the pre-emphasis voltage is increased, the possibility that the data driver 20 may normally receive the image signal IS may be increased. The level of the pre-emphasis voltage PE may be defined by an absolute value of a difference between a reference voltage Vcm and the voltage (Vpe+, Vpe−) of the pre-emphasis voltage PE.

Figure 3:
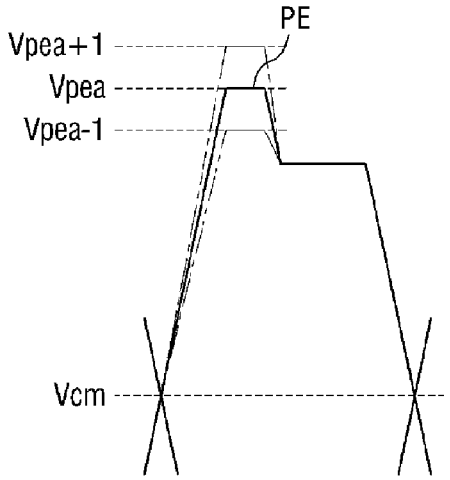
FIG. 3 is a waveform diagram of an image signal representing a change in a level of a pre-emphasis voltage in an exemplary embodiment of a liquid crystal display device, according to the invention.

Hereinafter, the pre-emphasis voltage PE will be described in greater detail with reference to FIG. 3. FIG. 3 is a waveform diagram of the image signal representing a change in a level of the pre-emphasis voltage in an exemplary embodiment of a liquid crystal display device, according to the invention.

Referring to FIG. 3, the level of the pre-emphasis voltage PE is variable. The timing controller 10 may increase or decrease the level of the pre-emphasis voltage PE. The timing controller 10 may determine one of the first to $x^{th}$ voltages as the level of the pre-emphasis voltage PE. The first to $x^{th}$ voltages may be aligned in an ascending order. When a is an integer larger than 1 and less than x, the $(a-1)^{th}$ voltage Vpea−1 may be lower than the $a^{th}$ voltage Vpea, and the $a^{th}$ voltage Vpe may be lower than the $(a+1)^{th}$ voltage Vpea+1.

Figure 4:
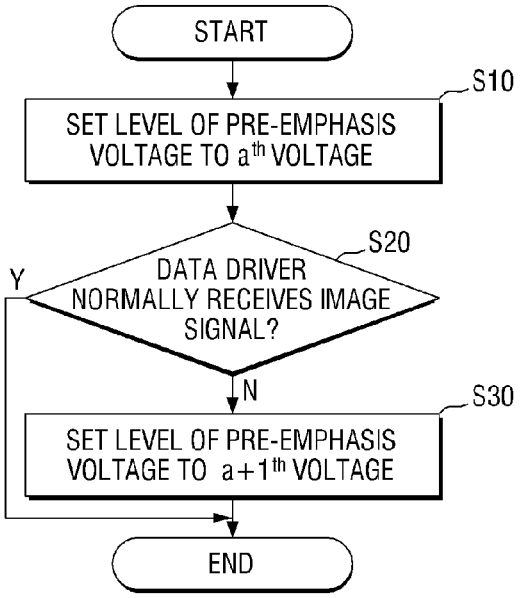
FIG. 4 is a flow chart illustrating an exemplary embodiment of a method of driving a display device, according to the invention.

Hereinafter, an exemplary embodiment of a method of determining a level of the pre-emphasis voltage PE by the timing controller 10 will be described with reference to FIG. 4. FIG. 4 is a flow chart illustrating an exemplary embodiment of a method of driving the display device, according to the invention.

Referring to FIG. 4, the method of driving the display device may include setting a level of the pre-emphasis voltage PE to the $a^{th}$ voltage Vpea (S10), determining whether the data driver 20 normally receives the image signal IS (S20), and setting the level of the pre-emphasis voltage PE to the $(a+1)^{th}$ voltage Vpea+1 (S30).

In the setting the level of the pre-emphasis voltage PE to the $a^{th}$ voltage Vpea (S10), the timing controller 10 may generate the image signal IS including the pre-emphasis voltage PE having the level of the $a^{th}$ voltage Vpea and provide the generated image signal IS to the data driver 20.

In the determining whether the data driver 20 normally receives the image signal IS (S20), the data driver 20 may receive the image signal IS, and provide information about whether the image signal IS is normally received to the timing controller 10. When the data driver 20 normally receives the image signal, the timing controller 10 may not change the level of the pre-emphasis voltage PE.

When the data driver 20 fails to normally receive the image signal IS, the setting the level of the pre-emphasis voltage PE to the $(a+1)^{th}$ voltage Vpea+1 (S30) may be performed. In the setting the level of the pre-emphasis voltage PE to the $(a+1)^{th}$ voltage Vpea+1 (S30), the timing controller 10 may set the level of the pre-emphasis voltage PE to the $(a+1)^{th}$ voltage Vpea+1, which is higher than current $a^{th}$ voltage Vpea by one level. By repeating the procedure illustrated in FIG. 4, the timing controller 10 may find the lowest level of the pre-emphasis voltage PE at which the data driver 20 may normally receive the image signal IS. In such an embodiment, the level of the pre-emphasis voltage PE is set to the lowest level of the pre-emphasis voltage PE at which the data driver 20 may normally receive the image signal IS, such that a reception rate, at which the data driver 20 receives the image signal IS, is increased, while reducing the power consumption of the display device 100.

Figure 5:
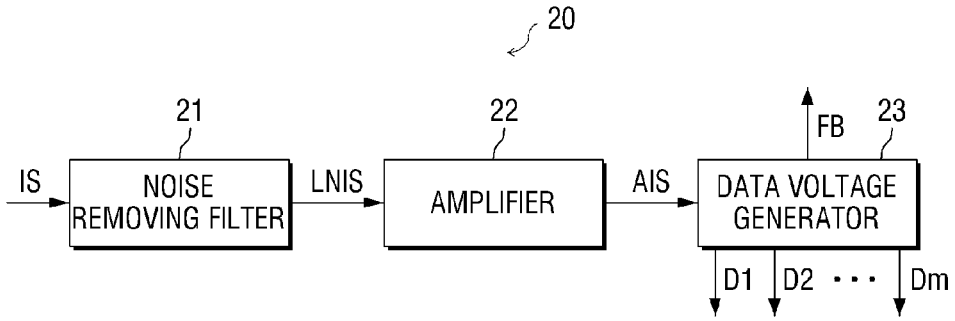
FIG. 5 is a block diagram illustrating an exemplary embodiment of a liquid crystal display device a data driver, according to the invention.

Hereinafter, an exemplary embodiment of the data driver 20 will be described in greater detail with reference to FIG. 5. FIG. 5 is a block diagram illustrating an exemplary embodiment of the data driver, according to the invention.

Referring to FIG. 5, an exemplary embodiment of the data driver 20 may include a noise removing filter 21, an amplifier 22 and a data voltage generator 23.

Figure 6:
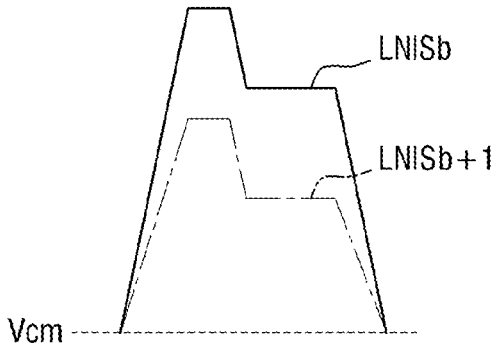
FIG. 6 is a waveform diagram of a low-noise image signal representing a change in a level of the low-noise image signal in an exemplary embodiment of a data driver, according to the invention.

The noise removing filter 21 may receive the image signal IS, and generate a low-noise image signal LNIS from the received image signal IS. The low-noise image signal LNIS may be a signal, in which the quantity of noises is decreased from the image signal IS. A level of the low-noise image signal LNIS may be lower than the level of the image signal IS. The low-noise image signal LNIS will hereinafter be described in greater detail with reference to FIG. 6. FIG. 6 is a waveform diagram showing the low-noise image signal representing a change in a level of the low-noise image signal in an exemplary embodiment of the data driver, according to the invention.

Referring to FIG. 6, the noise removing filter 21 may be operated with a plurality of steps, for example, first to $y^{th}$ steps. Herein, y is an integer greater than 1. An operation step of the noise removing filter 21 may be controlled by the timing controller 10. In an exemplary embodiment, as an operation step of the noise removing filter 21 is increased, efficiency of removing noises by the noise removing filter 21 may be improved. In such an embodiment, when the operation step of the noise removing filter 21 is increased, the quantity of noises included in the low-noise image signal LNIS may be decreased. Accordingly, the operation step of the noise removing filter 21 is increased, the level of the low-noise image signal LNIS may be decreased. As illustrated in FIG. 6, a level of a low-noise image signal LNISb+1 when the noise removing filter 21 is operated with the $(b+1)^{th}$ step may be lower than a level of a low-noise image signal LNISb when the noise removing filter 21 is operated with the $b^{th}$ step. Herein, b is an integer equal to or greater than 1 and less than y. According to an exemplary embodiment, when the noise removing filter 21 is operated with the first step, the noise removing filter 21 may not substantially perform a function thereof.

Referring back to FIG. 5, the amplifier 22 may receive the low-noise image signal LNIS, and generate an amplified low-noise image signal AIS by amplifying the received low-noise image signal LNIS. The amplifier 22 may maintain a level of the amplified low-noise image signal AIS to be substantially constant or uniform. An amplification gain of the amplifier 22 is variable according to the level of the low-noise image signal LNIS, and thus the level of the amplified low-noise image signal AIS may be substantially uniformly maintained.

The data voltage generator 23 may receive the amplified low-noise image signal AIS, and generate the plurality of data signals D1, D2, . . . , and Dm corresponding to the received amplified low-noise image signal AIS. The data voltage generator 23 may include a plurality of shift registers. The data voltage generator 23 may determine whether the data driver 20 normally receives the image signal IS by analyzing data included in the amplified low-noise image signal AIS, and notify the timing controller 10 the information about whether the data driver 20 normally receives the image signal IS or not through the feedback channel FB.

Figure 7:
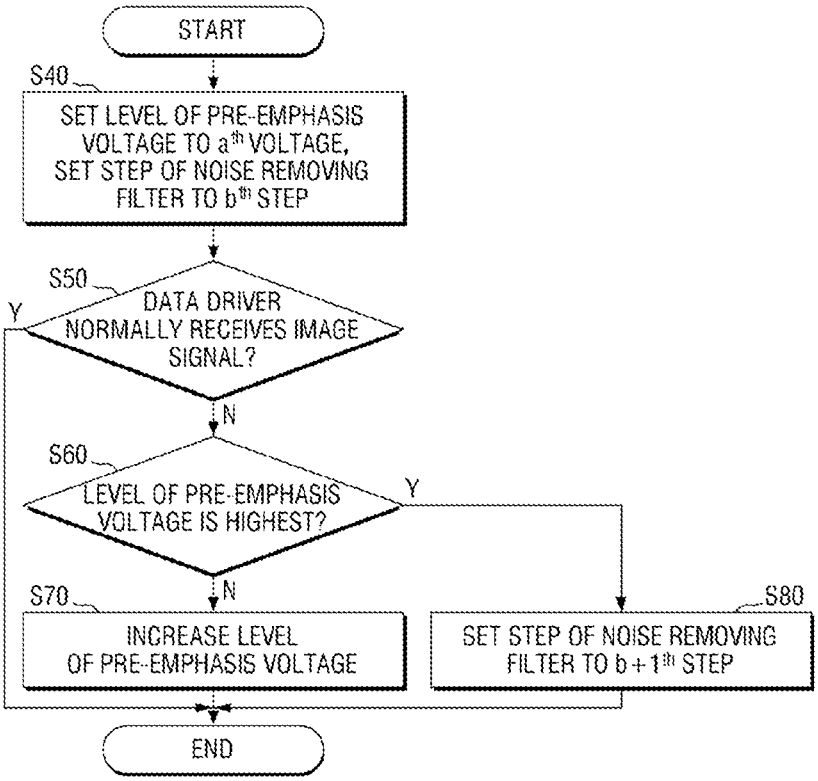
FIG. 7 is a flow chart illustrating an alternative exemplary embodiment of a method of driving a display device, according to the invention.

Hereinafter, an exemplary embodiment of a method of setting the operation step of the noise removing filter 21 will be described with reference to FIG. 7. FIG. 7 is a flow chart illustrating an alternative exemplary embodiment of a method of driving a display device, according to the invention.

Referring to FIG. 7, an exemplary embodiment of the method of driving the display device may include setting a level of the pre-emphasis voltage PE to the $a^{th}$ voltage, and setting the operation step of the noise removing filter 21 to the $b^{th}$ step (S40), determining whether the data driver 20 normally receives the image signal IS (S50), determining whether the level of the pre-emphasis voltage PE is the highest (S60), increasing the level of the pre-emphasis voltage PE (S70), and setting the operation step of the noise removing filter 21 to the $(b+1)^{th}$ step (S80).

In the setting the level of the pre-emphasis voltage PE to the $a^{th}$ voltage, and setting the operation step of the noise removing filter 21 to the $b^{th}$ step (S40), the timing controller 10 may generate the image signal IS including the pre-emphasis voltage PE having the level of the $a^{th}$ voltage Vpea, and provide the generated image signal IS to the data driver 20, and the timing controller 10 may control the noise removing filter 21 to be operated with the $b^{th}$ step.

In the determining whether the data driver 20 normally receives the image signal IS (S50), the data driver 20 may receive the image signal IS, and provide whether the image signal IS is normally received to the timing controller 10. In such an embodiment, the data voltage generator 23 may determine whether the data driver 20 normally receives the image signal IS by receiving the amplified low-noise image signal AIS. When the data driver 20 normally receives the image signal IS, the timing controller 10 may change the level of the pre-emphasis voltage PE or may not change the operation step of the noise removing filter 23.

The determining whether the level of the pre-emphasis voltage PE is the highest (S60) may be performed when the data driver 20 fails to normally receive the image signal IS. In the determining whether the level of the pre-emphasis voltage PE is the highest (S60), the timing controller 21 may determine whether the level of the pre-emphasis voltage PE is the highest, that is, whether the level of the pre-emphasis voltage PE is the $x^{th}$ voltage.

When it is determined that the level of the pre-emphasis voltage PE is the highest, the setting the operation step of the noise removing filter 21 to the $(b+1)^{th}$ step (S80) may be performed. In such an embodiment, when it is determined that the level of the pre-emphasis voltage PE is the highest, the timing controller 10 may increase the operation step of the noise removing filter 21 by one step.

When it is determined that the level of the pre-emphasis voltage PE is not the highest, the increasing the level of the pre-emphasis voltage PE (S70) may be performed. In the increasing the level of the pre-emphasis voltage PE (S70), the timing controller 10 may increase the level of the pre-emphasis voltage PE, and for example, the level of the pre-emphasis voltage PE may be set to the $(a+1)^{th}$ voltage.

According to an exemplary embodiment of the method of driving the display device 100, as illustrated in FIG. 7, when the data driver 20 fails to normally receive the image signal IS, the level of the pre-emphasis voltage PE is first increased, and when the data driver 20 fails to normally receive the image signal IS even when the level of the pre-emphasis voltage PE reaches the highest level, the operation step of the noise removing filter 21 may be then increased. In such an embodiment, when the level of the pre-emphasis voltage PE is increased, power consumption of the display device 100 may be increased by a level corresponding to a level increase of the pre-emphasis voltage PE, but when the operation step of the noise removing filter 21 is increased, the entire level of the low-noise image signal LNIS may be decreased. Accordingly, an increment of the power consumed for amplifying the low-noise image signal LNIS by the amplifier 22 may be less than increment of the power consumed when the level of the pre-emphasis voltage PE is increased. Accordingly, in an exemplary embodiment, the display device 100 may increase a reception rate at which the data driver 20 receives the image signal IS, and decrease power consumption of the display device 100.

Figure 8:
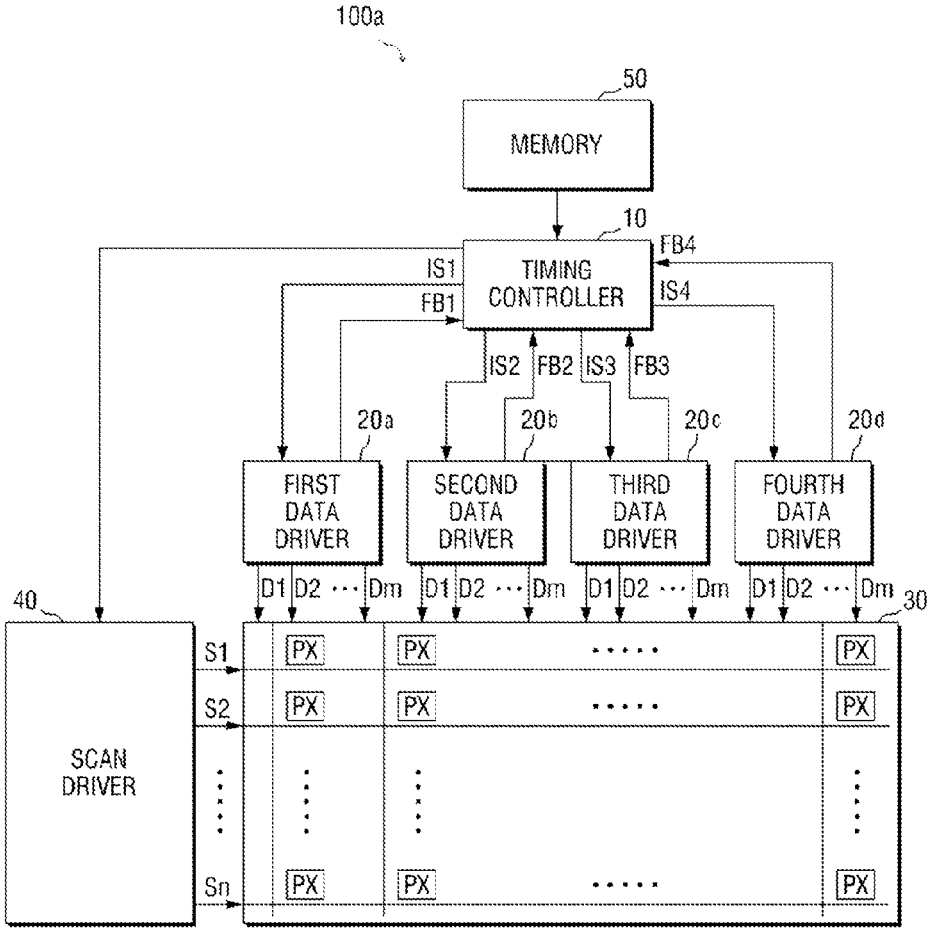
FIG. 8 is a block diagram showing an alternative exemplary embodiment of a display device, according to the invention.

Hereinafter, an alternative exemplary embodiment of the invention will be described with reference to FIG. 8. FIG. 8 is a block diagram showing an alternative exemplary embodiment of a display device, according to the invention.

Referring to FIG. 8, an alternative exemplary embodiment of a display device 100*a* may include a timing controller 10, a plurality of data drivers 20*a*, 20*b*, 20*c* and 20*d*, a display panel 30, a scan driver 40 and a memory 50.

The plurality of data drivers 20*a*, 20*b*, 20*c* and 20*d* may receive a plurality of image signals IS1, IS2, IS3 and IS4, respectively, and generate a plurality of data signals D1, D2, . . . , and Dm based on the received image signals IS1, IS2, IS3 and IS4, respectively, and the plurality of data drivers 20*a*, 20*b*, 20*c* and 20*d* may provide the generated data signals D1, D2, . . . , and Dm to the display panel 30. The plurality of data drivers 20*a*, 20*b*, 20*c* and 20*d* may transfer the plurality of data signals D1, D2, . . . , and Dm to pixels PX disposed in different regions of the display panel 30, and the plurality of data signals D1, D2, . . . , and Dm generated by the plurality of data drivers 20*a*, 20*b*, 20*c* and 20*d* may be different from each other. In an exemplary embodiment, as shown in FIG. 8, the plurality of data drivers may include four data drivers, that is, the first to fourth data drivers 20*a*, 20*b*, 20*c* and 20*d*, but not being limited thereto. In an alternative exemplary embodiment, the number of the data drivers 20*a*, 20*b*, 20*c* and 20*d* may be variously modified. Each of the plurality of data drivers 20*a*, 20*b*, 20*c* and 20*d* may transfer information about whether the plurality of image signals IS1, IS2, IS3, and IS4 is normally received or not to the timing controller 10 through separate feedback channels FB1, FB2, FB3 and FB4.

The timing controller 10 may generate the plurality of image signals IS1, IS2, IS3 and IS4, and transfer the generated image signals IS1, IS2, IS3 and IS4 to the plurality of data drivers 20*a*, 20*b*, 20*c* and 20*d*, respectively. The timing controller 10 may determine whether each of the plurality of data drivers 20*a*, 20*b*, 20*c* and 20*d* normally receives the plurality of image signals IS1, IS2, IS3 and IS4, and individually increase the level of the pre-emphasis voltage of each of the plurality of image signals IS 1, IS2, IS3 and IS4 independently of each other. In such an embodiment, the timing controller 10 may increase only the level of the pre-emphasis voltage of the image signal provided to the data driver, which fails to receive the image signal, among the plurality of data drivers 20*a*, 20*b*, 20*c* and 20*d*. In such an embodiment, the method of increasing the level of the pre-emphasis voltage by the timing controller is substantially the same as the exemplary embodiment of the method of increasing the level of the pre-emphasis voltage by the timing controller described with reference to FIG. 4.

Each of the plurality of data drivers 20*a*, 20*b*, 20*c* and 20*d* may include a noise removing filter 21, an amplifier 22 and a data voltage generator 23, as illustrated in FIG. 5. The timing controller 10 may determine whether each of the plurality of data drivers 20*a*, 20*b*, 20*c* and 20*d* normally receives the plurality of image signals IS1, IS2, IS3 and IS4, and individually set an operation level of the noise removing filter 21 in each of the plurality of data drivers 20*a*, 20*b*, 20*c* and 20*d*. In such an embodiment, a method of setting the operation level of the noise removing filter 21 is substantially the same as the exemplary embodiment of the method of setting the operation level of the noise removing filter 21 described with reference to FIG. 7.

The other features of the display device 100*a* shown in FIG. 8 are substantially the same as corresponding features in the exemplary embodiment of the display device 100 of FIG. 1, and any repetitive detailed description thereof will be omitted.

Figure 9:
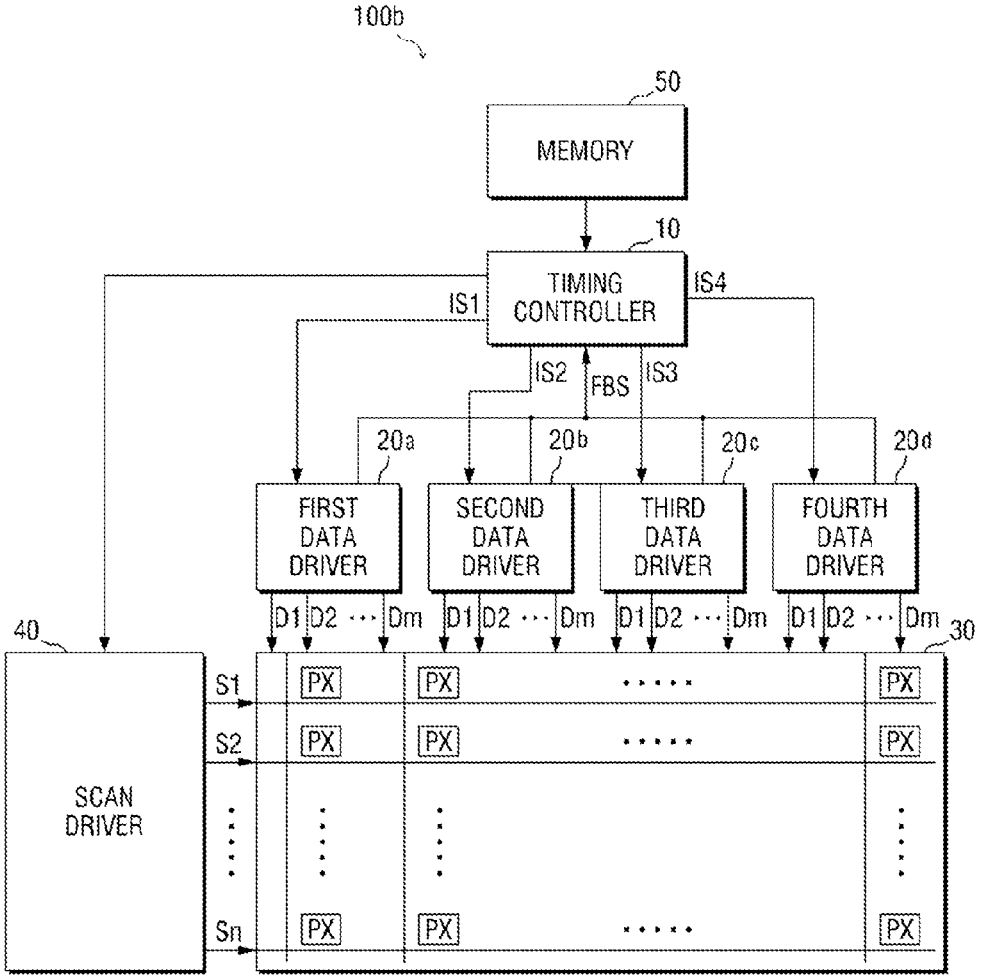
FIG. 9 is a block diagram showing another alternative exemplary embodiment of a display device, according to the invention.

Hereinafter, another alternative exemplary embodiment of the invention will be described with reference to FIG. 9. FIG. 9 is a block diagram showing another alternative exemplary embodiment of a display device, according to the invention.

Referring to FIG. 9, another alternative exemplary embodiment of a display device 100*b* may include a timing controller 10, a plurality of data drivers 20*e*, 20*f*, 20*g* and 20*h*, a display panel 30, a scan driver 40 and a memory 50.

The display device 100*b* in FIG. 9 is substantially the same as the display device 100*a* in FIG. 8 except that the plurality of data drivers 20*e*, 20*f*, 20*g* and 20*h* shares a same feedback channel FBS. The same or like elements shown in FIG. 9 have been labeled with the same reference characters as used above to describe the exemplary embodiment of the display device 100*a* shown in FIG. 8

In such an embodiment, where the plurality of data drivers 20*e*, 20*f*, 20*g* and 20*h* share the feedback channel FBS, the timing controller 10 may not determine which data driver fails to normally receive a plurality of image signals IS 1, IS2, IS3 and IS4, among the plurality of data drivers 20*e*, 20*f*, 20*g*, and 20*h*, and simply determines that at least one of the plurality of data drivers 20*e*, 20*f*, 20*g* and 20*h* fails to normally receive the image signal. Accordingly, when it is determined that at least one of the plurality of data drivers 20*e*, 20*f*, 20*g* and 20*h* fails to normally receive the image signal, the timing controller 10 may increase the levels of the pre-emphasis voltages PE in all of the plurality of image signals IS1, IS2, IS3, and IS4 transferred to the plurality of data drivers 20*e*, 20*f*, 20*g* and 20*h*. In such an embodiment, the method of increasing the level of the pre-emphasis voltage PE is substantially the same as the exemplary embodiment of the method of increasing the level of the pre-emphasis voltage PE described with reference to FIG. 4. Similarly, when it is determined that at least one of the plurality of data drivers 20*e*, 20*f*, 20*g* and 20*h* fails to normally receive the image signal, the timing controller 10 may increase operation steps of all of noise removing filters 21 included in the plurality of data drivers 20*e*, 20*f*, 20*g* and 20*h*. In such an embodiment, the method of increasing the operation steps of the plurality of noise removing filters 21 is substantially the same as the exemplary embodiment of the method of increasing the operation steps of the plurality of noise removing filters 21 described with reference to FIG. 7.

The other features of the display device 100*b* shown in FIG. 9 are substantially the same as corresponding features of the display device 100*a* of FIG. 8, and any repetitive detailed description thereof will be omitted.

The foregoing is illustrative of the invention and is not to be construed as limiting thereof. Although a few embodiments of the invention have been described, those skilled in the art will readily appreciate that many modifications are possible in the embodiments without materially departing from the novel teachings and advantages of the invention. Accordingly, all such modifications are intended to be included within the scope of the invention as defined in the claims. Therefore, it is to be understood that the foregoing is illustrative of the invention and is not to be construed as limited to the specific embodiments disclosed, and that modifications to the disclosed embodiments, as well as other embodiments, are intended to be included within the scope of the appended claims.

The invention is defined by the following claims, with equivalents of the claims to be included therein.

What is claimed is:

1. A display device, comprising:

a timing controller configured to generate an image signal comprising a pre-emphasis voltage;

a data driver configured to generate a plurality of data signals based on the image signal, and to provide information about whether the image signal is normally received or not, to the timing controller; and a display panel configured to receive the plurality of data signals and display images corresponding to the received data signals, wherein when the data driver fails to normally receive the image signal because of an increase in a quantity of noise in the image signal, the timing controller increases a level of the pre-emphasis voltage.

2. The display device of claim 1, wherein the level of the pre-emphasis voltage is one among first to $x^{th}$ voltages aligned in an ascending order, if the data driver fails to normally receive the image signal when the level of the pre-emphasis voltage is the $a^{th}$ voltage, the timing controller sets the level of the pre-emphasis voltage with the $(a+1)^{th}$ level, x is an integer larger than 1, and a is an integer equal to or larger than 1 and less than x.

3. The display device of claim 2, further comprising:

a memory configured to store information about the first to $x^{th}$ voltages.

4. The display device of claim 2, wherein the data driver comprises:

a noise removing filter configured to receive the image signal and output a low-noise image signal; and an amplifier configured to amplify the low-noise image signal and generate the amplified low-noise image signal.

5. The display device of claim 4, wherein the noise removing filter is operable with first to $y^{th}$ steps, when an operation step of the noise removing filter is increased, an efficiency of removing noise in the image signal by the noise removing filter is increased, and a level of the low-noise image signal is decreased, and y is an integer larger than 1.

6. The display device of claim 4, wherein a level of the amplified low-noise image signal is substantially uniform.

7. The display device of claim 4, wherein the timing controller controls an operation step of the noise removing filter, if the data driver fails to normally receive the image signal when the level of the pre-emphasis voltage is the $x^{th}$ voltage and the noise removing filter operates with a $b^{th}$ step, the timing controller sets the noise removing filter to operate with the $(b+1)^{th}$ step, and b is an integer equal to or larger than 1 and less than y.

8. The display device of claim 4, wherein the timing controller controls an operation step of the noise removing filter, when the level of the pre-emphasis voltage is not the $x^{th}$ voltage, the timing controller does not change the operation step of the noise removing filter, and b is an integer equal to or larger than 1 and less than y.

9. A display device, comprising:

a timing controller configured to generate a plurality of image signals, wherein each of the image signals comprises a pre-emphasis voltage;

a plurality of data drivers configured to receive the plurality of image signals, respectively, and generate a plurality of data signals based on the plurality of image signals, and to provide information about whether the plurality of image signals is normally received or not, to the timing controller; and a display panel configured to receive the plurality of data signals and display images corresponding to the received data signals, wherein when at least one data driver of the plurality of data drivers fails to normally receive an image signal provided thereto because of an increase in a quantity of noise in the image signal, the timing controller increases a level of the pre-emphasis voltage of the image signal provided to the at least one data driver, and the plurality of data drivers provides information about whether the plurality of image signals is normally received, to the timing controller, through one of a common channel and a plurality of channels, respectively.

10. The display device of claim 9, wherein when the at least one data driver fails to normally receive the image signal, the timing controller increases the level of the pre-emphasis voltage of each of the plurality of image signals.

11. The display device of claim 9, wherein the level of the pre-emphasis voltage is one among first to $x^{th}$ voltages aligned in an ascending order, if one data driver among the plurality of the data drivers fails to normally receive the image signal when the level of the pre-emphasis voltage of an image signal provided to the one data driver is the $a^{th}$ voltage, the level of the pre-emphasis voltage of the image signal provided to the one data driver is set to the $(a+1)^{th}$ level, x is an integer larger than 1, and a is an integer equal to or larger than 1 and less than x.

12. The display device of claim 11, further comprising:

a memory configured to store information about the first to $x^{th}$ voltages.

13. The display device of claim 11, wherein each of the plurality of data drivers comprises:

a noise removing filter configured to receive an image signal and output a low-noise image signal; and an amplifier configured to amplify the low-noise image signal and generate the amplified low-noise image signal.

14. The display device of claim 13, wherein the noise removing filter is operable with first to $y^{th}$ steps, when an operation step of the noise removing filter is increased, an efficiency of removing noise in the image signal by the noise removing filter is increased, and a level of the low-noise image signal is decreased, and y is an integer larger than 1.

15. The display device of claim 13, wherein a level of the amplified low-noise image signal is substantially uniform.

16. The display device of claim 13, wherein the timing controller controls an operation step of the noise removing filter, if the one data driver fails to normally receive the image signal when the level of the pre-emphasis voltage in the image signal provided to the one data driver is the $x^{th}$ voltage and the noise removing filter in the one data driver operates with the $b^{th}$ step, the timing controller sets the noise removing filter to operate with the $(b+1)^{th}$ step, and b is an integer equal to or larger than 1 and less than y.

17. The display device of claim 16, wherein the timing controller controls an operation step of the noise removing filter, and when the level of the pre-emphasis voltage of the image signal provided to the one data driver is not the $x^{th}$ voltage, and the one data driver fails to normally receive the image signal, the timing controller does not change the operation step of the noise removing filter, and b is an integer equal to or larger than 1 and less than y.

* * * * *